United States Patent [19]

Haglund

[11] Patent Number: 4,972,559

[45] Date of Patent: Nov. 27, 1990

[54] SAFETY BELT BUCKLE

[75] Inventor: Artur L. Haglund, Vargarda, Sweden

[73] Assignee: General Engineering (Netherlands) B.V., Utrecht, Netherlands

[21] Appl. No.: 258,700

[22] PCT Filed: Feb. 10, 1988

[86] PCT No.: PCT/SE88/00044

§ 371 Date: Oct. 11, 1988

§ 102(e) Date: Oct. 11, 1988

[87] PCT Pub. No.: WO88/06012

PCT Pub. Date: Aug. 25, 1988

[30] Foreign Application Priority Data

Feb. 10, 1987 [GB] United Kingdom ..... 8702915

[51] Int. Cl.[5] ..... A44B 1/04

[52] U.S. Cl. ..... 24/637; 24/634; 24/643

[58] Field of Search ..... 24/637, 633, 634, 636, 24/643, 648, 635, 646, 638; 297/468, 483; 280/801

[56] References Cited

U.S. PATENT DOCUMENTS

| | | | |
|---|---|---|---|
| Re. 27,438 | 7/1972 | Humphrey | 24/637 X |
| 2,863,200 | 12/1958 | Miller et al. | 24/634 X |
| 3,481,009 | 12/1969 | Preston et al. | 24/637 |

FOREIGN PATENT DOCUMENTS

| | | | |
|---|---|---|---|
| 196035 | 1/1922 | Fed. Rep. of Germany | 24/637 |
| 106488 | 6/1965 | Norway | 24/637 |

*Primary Examiner*—Laurie K. Cranmer

*Attorney, Agent, or Firm*—Spencer & Frank

[57] ABSTRACT

A buckle adapted to receive and retain a tongue mounted on a safety belt includes an actuating member mounted for rotation about a first predetermined axis to and from a latch position, the actuating member having an engaging portion, and a latching member mounted for rotation about a second predetermined axis. The latching member is movable between a first, latching position in which the latching member or a latching component driven thereby engages a tongue to retain the tongue latched in the buckle and a second, release position in which the tongue may be released from or introduced into the buckle. The actuating member and the latching member are mechanically interconnected so that rotation of the actuating member causes rotation of the latching member, and the latching member has an abutment portion for engagement with the engaging portion of the actuating member for retaining the latching member in the first, latching position such that the actuating member must move from the latch position before the latching member can be moved to the release position. The angular moments of inertia of the actuating member and the latching member about their axes of rotation are such that, when the buckle is subjected to an acceleration, the latching member will not move to the release position.

10 Claims, 4 Drawing Sheets

Fig. 1.
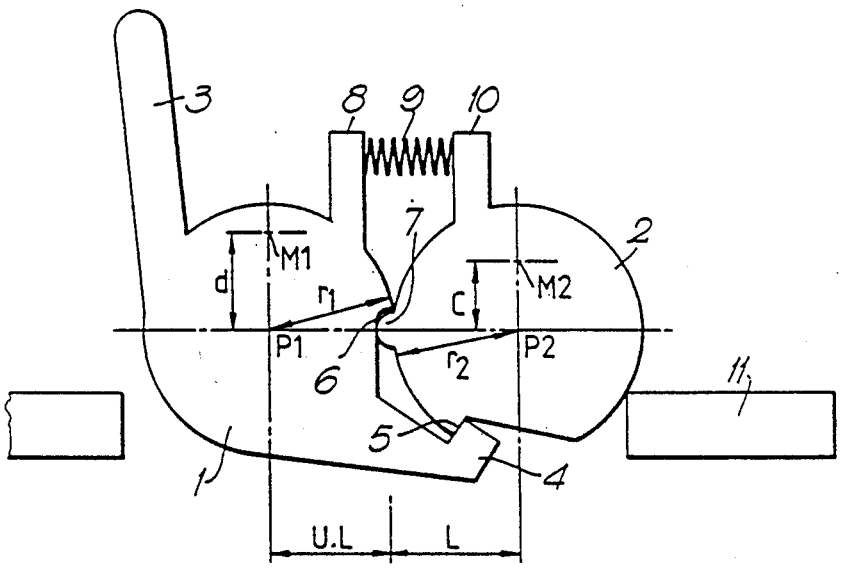
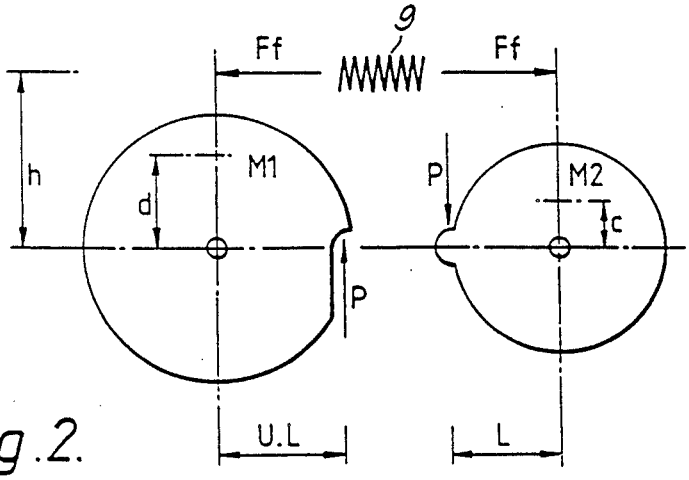
Fig. 2.
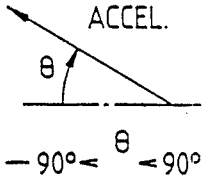
Fig. 2A

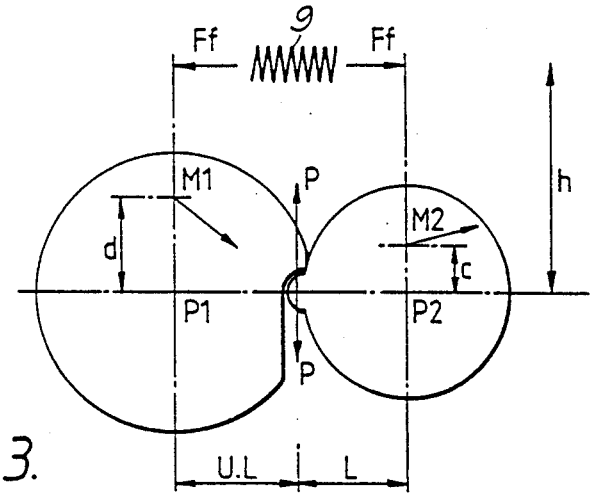
Fig.3.
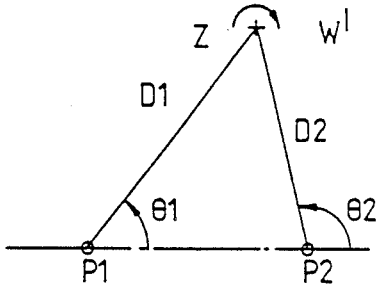
Fig.3A
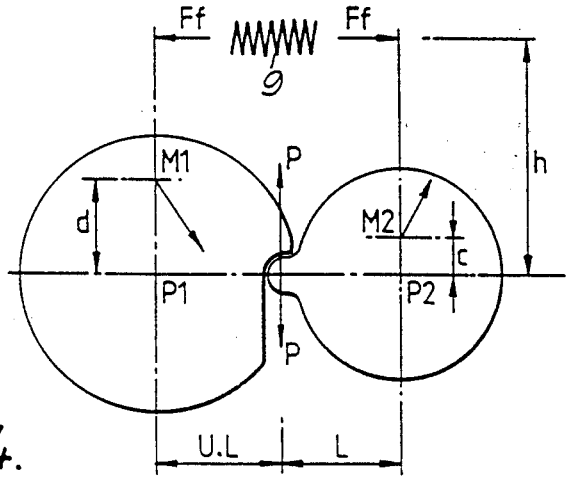
Fig.4.
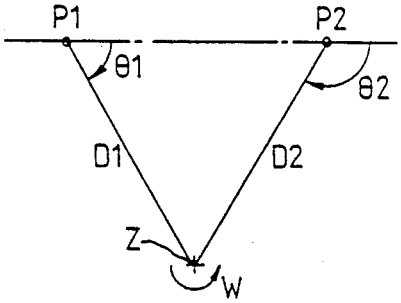
Fig.4A
Fig.5.
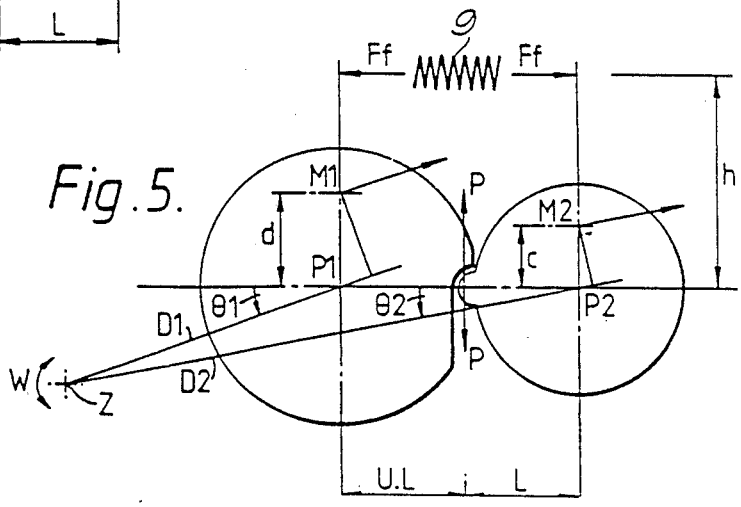

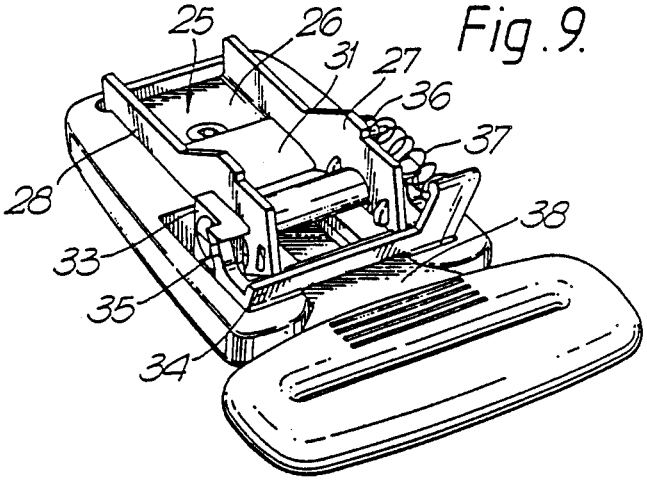
Fig. 9.
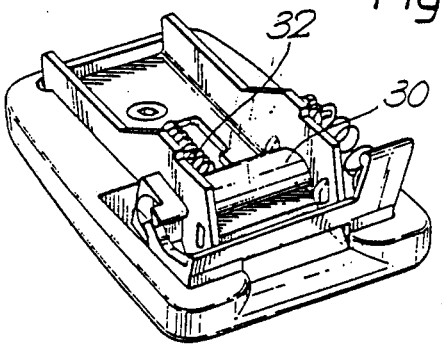
Fig. 10.
Fig. 11.
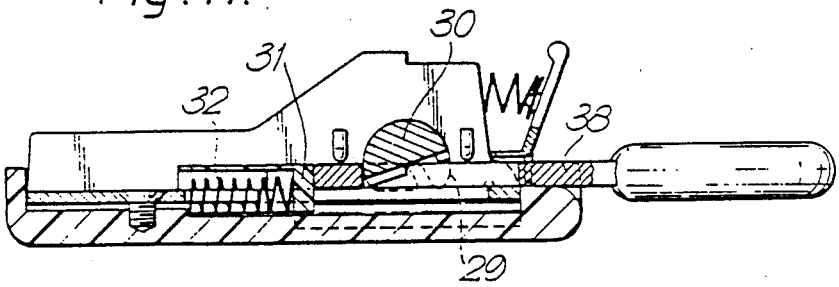

SAFETY BELT BUCKLE

BACKGROUND OF THE INVENTION

The present invention relates to a safety belt buckle and more particularly relates to a buckle intended for use in a vehicle such as a motor car.

Safety belts are now widely used in motor vehicles, and it is common practice to have a safety belt provided with a tongue which, in use, is inserted into a buckle. The buckle receives the tongue and locks the tongue in position until the buckle is released by actuating a push button or the like.

Many alternative designs of buckle have been proposed previously. Many of the prior proposed buckles suffer from the disadvantage that if the buckle is subjected to a very severe acceleration in the form of a linear acceleration, an angular acceleration or a centrifugal acceleration, the component or components within the buckle which serve to retain the tongue in position may be moved, thus causing the tongue to become released from the buckle. It is to be appreciated that a buckle of this type is utilised with the intention of retaining a person travelling in a motor vehicle strapped securely to his or her seat should an accident occur. Often, in an accident situation, a buckle may be subjected to a severe acceleration in the form of a linear or angular acceleration, or a centrifugal acceleration, and thus the tongue may be released from the buckle at the precise moment that it is most important that the tongue is retained in the buckle.

SUMMARY OF THE INVENTION

The present invention seeks to provide a buckle which will not be inadvertently released when subjected to linear acceleration or an angular acceleration, or a centrifugal acceleration.

According to this invention there is provided a buckle adapted to receive and retain a tongue mounted on a safety belt, said buckle comprising an actuating member mounted for rotation about a predetermined axis, and a latching member mounted for rotation about a predetermined axis, the latching member being movable between a first position in which the latching member or a latching component driven thereby engages a tongue to retain the tongue latched in the buckle and a second release position in which the tongue may be released from or introduced into the buckle, the actuating member and the latching member being mechanically interconnected so that rotation of the actuating member causes rotation of the latching member, there being a mechanical advantage between the actuating member and the latching member, the angular moments of inertia of the actuating member and the latching member about their axes of rotation being such that, with regard to the said mechanical advantage, when the buckle is subjected to an acceleration the latching member will not move to the release position.

Preferably the actuating member is provided with engaging means which, when the actuating member is in its initial position, engage an abutment or the like on the latching member to retain the latching member in the latching position, so that the actuating member must move from the initial position before the latching member can be moved to the release position.

Conveniently the actuating member has means thereon which, after a rotation of the actuating member sufficient to disengage said engaging means and said abutment, come into contact with means present on the latching member to effect a driving connection between the actuating member and the latching member so that continued rotation of the actuating member causes rotation of the latching member.

Advantageously resilient means are provided connected to the latching member and the actuating member, biassing the latching member to its latching position and biassing the actuating member to its initial position.

Conveniently the latching member and the actuating member are rotatably mounted on a channel member.

Preferably the actuating member comprises integrally formed manually operable actuating means.

Conveniently said integrally formed means are in the form of a protruding tab.

According to another aspect of this invention there is provided a buckle adapted to receive and retain a tongue mounted on a safety belt, said buckle comprising an actuating member, the actuating member being mounted for rotation about a predetermined axis, and having a mass M1 and being directly or indirectly actuable to effect such rotation, and a latching member having a mass M2 rotatably mounted in position for rotation about an axis, the latching member being movable between a first position in which the latching member or a latching component driven thereby engages the tongue to retain the tongue latched in the buckle, and a latching position in which the tongue is released; the actuating member having means to engage and retain the latching member to retain the latching member in the latching position and having means which, on rotation of the actuating member, engage and drive the latching member, the actuating member and the latching member each having a centre of gravity, the centre of gravity of the actuating member being a distance d from the axis of rotation thereof and the centre of gravity of the latching member being a distance c from the axis of rotation thereof, the latching member having an effective radius R1 and the actuating member having an effective radius R2, the effective radius being the distance between the respective axis of rotation and the said means on the actuating member which engage and drive the latching member, the centres of gravity both being disposed on one side of a common plane containing the axes of rotation of the latching member and the actuating member, the ratio of the effective radii of the actuating member and the latching member being greater than the ratio between M1. d and M2. c.

Preferably the latching member and the actuating member are rotatably mounted on a channel member.

Conveniently the actuating member comprises integrally formed manually operable actuating means.

Advantageously the said integrally formed means are in the form of a protruding tab.

Preferably the means on the actuating member to engage and retain the latching member comprises a projection adapted to engage an abutment formed on the latching member.

Conveniently the latching member has means formed integrally therewith to engage the tongue to retain the tongue in the buckle when the latching member is in a latching position.

Preferably resilient means are provided to bias the latching member to the latching position.

Advantageously the resilient means comprise a spring engaging the latching member and the actuating member, the spring serving to bias the latching member towards the latching position and also serving to bias the actuating member to a position in which the means on the actuating member engage the latching member to retain the latching member in the latching position.

According to another aspect of this invention there is provided a buckle comprising a channel element, a latching member extending transversely of the channel element and being rotatably mounted for rotation between a latching position in which part of the latching member engages an abutment on a tongue inserted into the channel and a release position in which there is no such engagement, there being a pivotally operation, having means projecting therefrom to engage means extending from said latching member to effect rotation thereof.

Preferably when the buckle is in the latched condition the means projecting from the actuating element are adjacent at least part of said means extending from the latching member to prevent rotation thereof to the release position.

Conveniently the latching member and the actuating member are biassed by a single spring engaging the actuating member and the latching member.

BRIEF DESCRIPTION OF THE DRAWINGS

In order that the invention may be more readily understood, and so that further features thereof may be appreciated, the invention will now be described, by way of example, with reference to the accompanying drawings in which:

FIG. 1 is a diagrammatic side view of important components of a buckle in accordance with the invention, FIG. 2 is a diagrammatic representation of the components shown in FIG. 1 indicating a linear acceleration applied to the components, and FIG. 2A is a vector diagram indicating acceleration of the components of FIG. 2;

FIG. 3 is a representation corresponding to FIG. 2 showing an applied clockwise angular acceleration, and FIG. 3A is a vector diagram indicating applied angular acceleration of the components of FIG. 3;

FIG. 4 is a representation corresponding to FIG. 3 showing an applied counterclockwise angular acceleration, and FIG. 4A is a vector diagram indicating applied counter-clockwise angular acceleration of the components of FIG. 4;

FIG. 5 is a representation corresponding to FIGS. 3 and 4 showing the situation if the buckle is subjected to constant angular velocity.

FIG. 9 is a perspective view of one embodiment of a buckle incorporating the invention with the tongue inserted, FIG. 10 is a view of the buckle of FIG. 9 with the tongue ejected, and FIG. 11 is a sectional view of FIG. 10.

DETAILED DESCRIPTION OF THE PREFERRED EMBODIMENT

Figure 6:
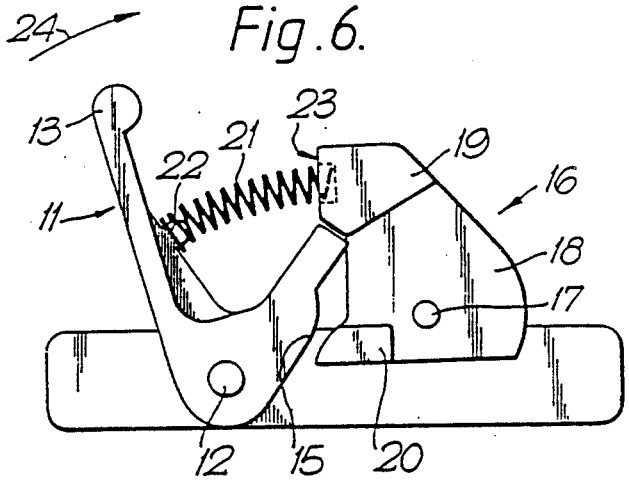
FIG. 6 is a diagrammatic side view of an alternate embodiment of the invention in the latching condition.

Referring initially to FIG. 1 of the accompanying drawings a buckle in accordance with the present invention comprises an actuating member or acterator member 1 and a latching member 2. The actuating member, is mounted for rotation about an axis P1. The actuating member has a mass M1 and a centre of gravity which is located a distance d from the centre of rotation P1. The latching member 2 is also mounted for rotation about an axis P2, and has a mass M2 and a centre of gravity located a distance c from the axis P2. Both of the distances c and d may be very small. Both the centres of gravity M1 and M2 are located to one side of a plane containing the two axes of rotation P1 and P2. In the condition shown in FIG. 1 the buckle is latched and the lines that join the centres of gravity to the axes of rotation are parallel and are perpendicular to the plane containing the axes of rotation.

The actuating member 1 is intended to be rotated when the buckle is to be released. Whilst a mechanism may be provided including various intermediate components, in the embodiments illustrated the actuating member 1 is provided with a protruding tab 3 which constitutes a push button. When the tab 3 is pressed manually the actuating member 1 may rotate in a clockwise direction as shown in FIG. 1.

The actuating member 1 is provided with a protruding hook-like projection 4 which engages a corresponding detent 5 provided in the latching member 2. When the hook 4 and detent 5 are interengaged the latching member 2 cannot rotate in the anti-clockwise direction. The actuating member 1 has a detent 6 in the form of a recess which, as can be seen from FIG. 1, is positioned to cooperate with a projection 7 provided on the periphery of the latching member 2.

The arrangement is such that when the actuating member 1 moves in the clockwise direction initially the hook 4 is disengaged from the detent 5 on the latching member 2, and subsequently the detent 6 on the actuating member engages the projection 7 on the latching member 2, so that continuing rotation of the actuating member 1 in the clockwise direction drives the latching member 2 in the anti-clockwise direction.

The latching member 1 has a projection 8 to which is connected a spring 9, the other end of the spring being connected to a corresponding projection 10 formed on the latching member 2. The spring tends to bias the actuating member 1 in an anti-clockwise direction and the latching member 2 in a clockwise direction, thus effectively forcing the hook 4 into engagement with the detent 5. When the hook 4 is in engagement with the detent 5 the buckle is in a locking position. It is intended that a tongue 11 will then be retained within a buckle housing by engagement of part of the tongue with a locking surface formed on part of the latching member 2. However, it is intended that when the tab 3 is depressed and the actuating member is moved clockwise and the latching member 2 has moved anti-clockwise, thus compressing the spring 9, the locking surface on the latching member 2 will be disengaged from the tongue 11, and the tongue 11 may then be freely removed from the buckle.

The effective radius r1 of the actuating member is the distance between the centre of rotation P1 and the detent 6. The effective radius r2 of the latching member 2 is the distance between the centre of rotation P2 and the projection 7. The ratio between these two distances is U. As can be seen from FIG. 1 the distance between the two centres of rotation P1 and P2 can be considered to be made up of a portion having a length U . L and a further portion having a length L.

The buckle described above has been designed to prevent self-opening at high in-plane accelerations such as linear acceleration, and angular acceleration or a centrifugal acceleration.

The ratio of the effective radii of the actuator member 1 and the latching member 2, U, has been chosen to have a value greater than M1.d/M2.c.

Considering initially the effect of linear acceleration it can be seen immediately that any linear acceleration acting on the center of mass M1 which tends to cause the actuating member 1 to move in an anti-clockwise direction can be ignored, since this will tend to reinforce the grip between the hook 4 and the detent 5, thus preventing the buckle from becoming released. Thus, any acceleration on the mass M1 capable of opening the buckle must be towards the left, as shown in FIG. 2. Thus, effectively, the acceleration must have a component which acts in a direction to the left, i.e. the acceleration vector must be directed at an angle $\theta$ (shown in FIG. 2) which can have any value in the range of $-90°$ to $+90°$. In FIG. 2 the acceleration direction is shown by the arrow ACCEL.

The spring 9 applies an equal and opposite force to the actuating member and the latching member, this force being Ff. The spring force Ff is applied to the actuating member 1 and the latching member 2 at a distance h above the plane carrying the axes of rotation P1 and P2. It is assumed, for the sake of the following mathematical analysis, that the detent 6 contacts the projection 7 and an equal and opposite force P is exerted on the detent 6 and the projection 7.

When subjected to a linear acceleration equilibrium for the actuator member is defined by the following equation:

$$M_1.\ \text{acceleration}.\ d\ .\ \cos\theta = P.\ U.\ L + Ff\ .\ h$$

Equilibrium for the latching member 2 is defined by the following equation:

$$M_2.\ \text{acceleration}\ .\ c\ .\ \cos\theta = P\ .\ L - Ff\ .\ h$$

From these two equations the acceleration limit A (at which opening occurs) is found to be:

If the last equation (containing $M_2$) is multiplied by U, and the resulting equation substracted from the previous equation (containing M1) results in:

$$\text{acceleration}\ .\ \cos\theta(M1.d - U.M2.c) = 0 + Ff.h + U.Ff.h$$

Rearranging terms to solve for the acceleration A results in:

$$A = Ff\ .\ h\ .(1+U)/\cos\theta(M_1.d - M_2.c.U)$$

Thus, if U is greater than M1*d*/M2*c* (M1.*d*−M2.*c*. V) mechanism will not open for any linear acceleration.

With reference to FIG. 3, consideration will now be given to clockwise angular acceleration. It is to be assumed that the buckle is to be rotated about a point Z with an angular acceleration W'. The point Z is situated at a distance D1 from the point P1 and the distance D2 from the point P2. The lines joining points P1 and P2 to the distance Z establish angles $\theta 1$ and $\theta 2$ respectively with the plane joining the points P1 and P2. It is assumed that the distances c and d are small compared with the distances D1 and D2. It is also assumed that $\theta 2$ is greater than $\theta 1$ and that both $\theta 1$ and $\theta 2$ lie within the range of 0° to 180°.

The centrifugal acceleration can be neglected, so that the only acceleration to be considered is the tangential acceleration.

Equilibrium for the actuator member 1 is defined by the following, first equation:

$$M_1D_1.W'.d.\ \sin\theta 1 = P.U.L + Ff.h$$

Equilibrium for the actuator member is defined by the following, second equation: $M_2D_2.W'.c.\ \sin\theta 2 = P.L + Ff.h$.

It can be seen from the drawing that D1 $\sin\theta 1$ = D2 $\sin\theta 2$. Rearranging the terms of the second equation while substituting D1 . $\sin\theta 1$ for D2 . $\sin\theta 2$ and multiplying U results in the following, third equation:

$$U.M2.c.W'.D1.\ \sin\theta 1 = U.P.L - U.Ff.h$$

Subtracting the third equation from the first equation results in the following, fourth equation:

$$(M1.d - U.M2.c)W'.D1.\ \sin\theta 1 = 0 + Ff.h + U.Ff.h$$

Thus in this case the acceleration limit will therefore be:

$$\frac{Ff \cdot H \cdot (1 + U)}{D1 \cdot \sin\theta 1(M1 \cdot d - M2 \cdot C \cdot U)}$$

For this limit to be maximum, the term M1 . d . M2 . c . U should be made to be very small, preferably zero.

Thus it will again be seen that when U is greater than $M_1$ . D/$M_2$ . C, a no-opening condition is obtained for any angular condition.

Turning now to FIG. 4 consideration will be given to counterclockwise angular acceleration. The same considerations apply in FIG. 4, as in FIG. 3., and again the buckle is considered to be rotated about the point Z. Again c and d are considered much less than the distances D1 and D2 between the points P1 and P2 and the centre of rotation Z. Also $\theta$ is considered to be greater than $\theta 1$ and both $\theta 1$ and $\theta 2$ are to be considered to be between 0° and 180°.

From the figure it can be seen that forces act in the same directions as they do when rotation is clockwise. Thus the equations given above with regard to FIG. 3 will apply equally to the FIG. 4 situation.

Turning now to FIG. 5 consideration will be given to centrifugal acceleration at a constant velocity of revolution. Again, in this figure, the centre of rotation Z is located at a distance D1 from the axis P1 and a distance D2 from the axis P2, and the lines joining the centre of rotation Z and the axes P1 and P2 make angles $\theta 1$ and $\theta 2$ with the plane joining the axes P1 and P2. As above, c and d are considered to be much less than distances D1 and D2, and the angles $\theta 1$ and $\theta 2$ are considered to be between $-90°$ and $+90°$. The angular rotation about the centre of rotation is W.

Equilibrium for the actuating element 1 is defined by the following equation:

$$(M_1.D1.W^2).d.\ \cos\theta 1 = P.U.L + Ff.h$$

Equilibrium for the latching member 2 is defined by the following equation:

$$(M_2.D2.W^2).c.\ \cos\theta 2 = P.L - Ff.h$$

From the figure it can be seen that D2 . cos θ2 is greater than D1 . cos θ1. Multiplying the above equation (containing M2) by U, then substracting it from the previous equation (containing M1) produces the following:

$$W^2(M1.d.D1.\cos\theta 1)-(U.M2.c.D2.\cos\theta 2)=0+Ff.h+U.Ff.h$$

Rearranging the terms of the above equation to solve for $W^2$ resulting in:

$$W^2=\frac{(1+U)Ff\cdot h}{(M1\cdot d\cdot D1\cos\theta 1)-(U\cdot M2\cdot c\cdot D2\cdot\cos\theta)}$$

This gives a velocity limit. $W^2$ tends to infinity when U is greater than $(M_1d/M_2 . c) . d_1 . \cos\theta 1/d_2 \cos\theta 2$.

Thus the previous requirement for U to be greater than $M_1d/M_2c$ is on the conservative side for non-opening behaviour.

It is thus believed that the buckle in accordance with the invention, as described above, will not open when subjected to an acceleration force.

It will thus be appreciated that, in the above-described embodiment of the invention, the moments of inertia of the latching member 2 and actuating member 1, and the mechanical interconnection between said members, including the mechanical advantage between the actuating member 1 and the latching member 2 are such that, regardless of the acceleration force applied to the buckle, the latching member will not of itself move from the latching position to the release position.

Figure 7:
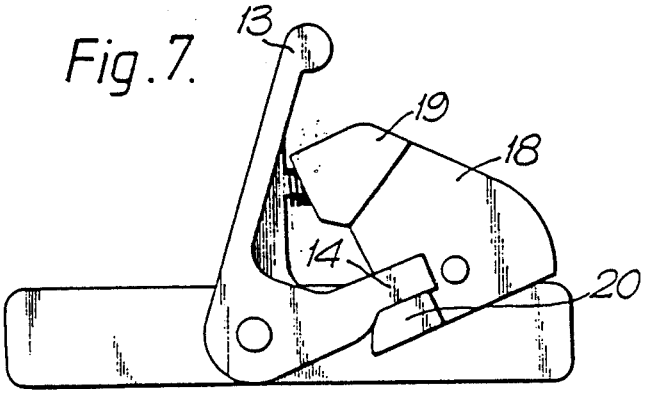
FIG. 7 is a corresponding view showing the alternate embodiment being moved to the release position.
Figure 8:
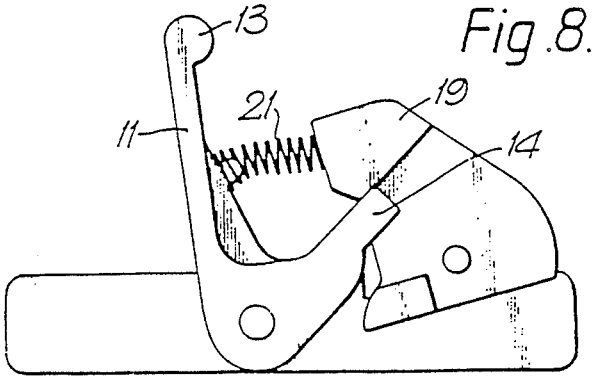
FIG. 8 shows the alternate embodiment in the release position.

FIGS. 6 to 8 illustrate another embodiment of the invention by way of example. In this embodiment of the invention an actuating member 11 is mounted for rotation about an axis of rotation 12. The actuating member is provided with a protruding portion 13 in the form of a push button which can be pushed inwardly to actuate the actuating member 11. The actuating member 11 is also provided with an extension 14 in the form of a substantially radially extending projection, which extends towards the latching member, as will be described, and is also provided with an arcuate surface 15, directed towards part of the latching member 16.

The latching member 16 is mounted for rotation about an axis of rotation 17. The latching member 16 is provided with an end face 18 having projections 19, 20 adapted to cooperate with the actuating member, as will be described, but the central portion of the latching member 16 may have any suitable configuration for engagement with a tongue in a buckle.

The end face 18 provided on the latching member 16 is provided with two axially extending projections 19, 20 which are both spaced radially from the centre of rotation of the latching member 16, and which are so positioned that, when the buckle is in the latching position, as shown in FIG. 6, the projection 19 is adjacent the free end of the extension 14 provided on the latching member, and the projection 20 is located adjacent the arcuate surface 15 present on the actuating member 11. Thus, if the latching member begins to rotate away from the latching position, in an anti-clockwise direction as seen in FIG. 6 towards the release position, the projection 19 will engage the free end of the radially extending extension 14 present on the actuating member 11, thus effectively preventing the latching member 16 from moving away from the latching position. It can be seen that the arcuate portion 15 provided on the actuating member 11 is spaced slightly from the projection 20 formed on the latching member 16.

A spring 21 is provided, the spring being located on a projection 22 provided on the rear surface of the protruding portion 13 and a recess 23 formed in the projection 19.

As will be understood from FIG. 6, when the protruding portion 13 is pressed in the direction of the arrow 24 initially the spring 21 is slightly compressed, and the radial projection 14 is moved out of alignment with the projection 19, so that the latching member 16 is thus permitted to rotate anti-clockwise. This movement also brings the arcuate surface 15 into engagement with the projection 20. Further movement of the actuating member 11 in the direction of the arrow 24 causes the arcuate surface 15 to engage the projection 20, and thus effect rotation of the latching member 16 in the anti-clockwise direction, thus moving the latching member 16 to the release position.

When the protruding portion 13 has been pressed fully home, the illustrated components have the configuration as shown in FIG. 7. When in this configuration, the latching member 16 is moved to the release position, and the tongue, initially present in the buckle, is ejected by means of a spring biassed ejector. Part of the ejector comes to rest under the latching member 16, thus preventing the latching member 16 from returning fully to the locking condition.

If the protruding portion 13 is then released, under the bias of the spring 21, the actuating member 11 is rotated in an anti-clockwise direction. However, the projection 14 on the latching member 11 then engages the side face of the projection 19. Thus the actuating member 11 does not return to its initial position, but instead is retained in the position illustrated in FIG. 8.

As in the previously described embodiment, the angular moments of inertia of the latching member 16 and the actuating member 11, and their mechanical interconnection and the mechanical advantage between the members will be so selected that when the buckle is subjected to acceleration, the latching member 16 will not be moved towards the release position.

FIGS. 9 to 11 illustrate an example of a buckle incorporating the invention. The buckle incorporates a channel member 25 having a channel formed by a flat base 26 and two upstanding side walls 27; 28. Apertures 29 (see FIG. 11) are formed in the side walls, and a latching member 30 extends across the channel, passing through the apertures. The latching member 30 is rotatable about its longitudinal axis.

Slidably mounted on the base 26 of the channel member 25 is an ejector 31 which is biassed forwardly by means of a spring 32, as is conventional.

Associated with the latching member 30, on the exterior of the channel, on one side of the channel, is an end portion 33 having an end face and projections corresponding to the described end face 18 and projections 19, 20. An actuating element 34 is provided which is mounted for pivotal movement and which has an extension 35 to cooperate with the projections formed on the end portion 33 of the latching member 30. The actuating element 34 and the extension 35, correspond to the actuating member 11 and the projection 14 as illustrated in FIGS. 6 to 8. The other end of the latching member 30 is provided with an end element forming an abutment 36 for one end of a spring 37 which engages part of the actuating member 34 to bias it forwardly. The end element carrying the abutment 36 may also carry projections corresponding to the projections 19, 20 for co-operation with a further extension, corresponding to the extension 35, on the actuating element 34.

The buckle is illustrated in FIGS. 9 and 11 with a tongue 38 inserted in the buckle. It can be seen that the latching member 30 is in the latching position, so that the tongue cannot be withdrawn from the buckle.

In operation of the buckle, the actuating element is manually operated to move pivotally against the bias of the spring 37, and the projection 35 then cooperates with the projections provided on the end portion 33 of the latching member 30, in a manner as described above with reference to FIGS. 6 to 8. The latching member is thus rotated, releasing the tongue 38 which is moved towards the right, as shown in FIG. 11, by the spring biassed ejector 31. The spring biassed ejector 31 comes to rest under the latching member 30, thus preventing the latching member 30 from returning to the latching condition.

As will be appreciated, the actuating element 34 will then adopt a position such as is illustrated in FIG. 8.

If the tongue is then re-inserted into the buckle, the tongue moves the spring-biassed ejector 31 towards the left as shown in FIG. 11, and the latching member 30 then returns to the latching condition under the bias of the spring 37 as applied to the abutment 36. The cycle of operation is thus complete.

Whilst the invention has been described with reference to one particular embodiment in which the actuating member is directly actuated, it is to be understood that it may be an intermediate mechanism between manually operable actuating means and the actuating member. Additionally, whilst in the described embodiment the latching member acts directly on the tongue, the latching member could act on the tongue via one or more intermediary latching components.

I claim:

1. A buckle adapted to receive and retain a tongue mounted on a safety belt, said buckle comprising an actuating member, the actuating member being mounted for rotation about a predetermined first axis, and having a mass M1 and being actuable to effect such rotation, and a latching member having a mass M2 and being rotatably mounted in position for rotation about a second axis, the latching member being movable between a first latching position in which the latching member or a latching component driven thereby engages the tongue to retain the tongue latched in the buckle, and a second release position in which the tongue is released; the actuating member having first means to engage and retain the latching member in the latching position and having second means which, on rotation of the actuating member, engage and drive the latching member, the actuating member and the latching member respectively each having a centre of gravity, the centre of gravity of the actuating member being a distance d from the first axis and the centre of gravity of the latching member being a distance c from the second axis, the latching member having an effective radius R2 and the actuating member having an effective radius R1, the effective radius of the latching member and of the actuating member being respectively defined as the distance between the second axis of rotation and the said means on the actuating member which engage and drive the latching member and the distance between the first axis of rotation and the means on the actuating member which engage and drive the latching member, the centres of gravity of the actuating member and the latching member both being disposed on one side of a common plane containing the first and second axes of rotation, the ratio of the effective radii of the actuating member to the latching member being greater than the ratio of M1.d to M2.c.

2. A buckle according to claim 1, wherein the second means on the actuating member, after a rotation of the actuating member sufficient to disengage the first means and the second means, come into contact with the first means on the latching member to effect a driving connection between the actuating member and the latching member so that continued rotation of the actuating member causes rotation of the latching member.

3. A buckle according to claim 1, further comprising resilient means connected to the latching member and the actuating member for biassing the latching member to its latching position and for biassing the actuating member to an initial position.

4. A buckle according to claim 1, further comprising a channel member rotatably supporting the latching member and the actuating member.

5. A buckle according to claim 1 wherein the actuating member comprises integrally formed manually operable actuating means.

6. A buckle according to claim 5 wherein the said integrally formed means are in the form of a protruding tab.

7. A buckle according to claim 1 wherein the means on the actuating member to engage and retain the latching member comprise a projection adapted to engage an abutment formed on the latching member.

8. A buckle according to claim 1 wherein the latching member has means formed integrally therewith to engage the tongue to retain the tongue in the buckle when the latching member is in the latching position.

9. A buckle according to claim 1, further comprising resilient means for biasing the latching member to the latching position.

10. A buckle according to claim 9, wherein the resilient means comprises a spring engaging the latching member and the actuating member, the spring serving the latching member towards the latching position and also serving to bias the actuating member to an engaging position in which the first means on the actuating member engages the latching member to retain the latching member in the latching position.

* * * * *